US009748741B2

(12) United States Patent
Menken et al.

(10) Patent No.: US 9,748,741 B2
(45) **Date of Patent: *Aug. 29, 2017**

(54) SPARK PLUG ELECTRODE MATERIAL AND SPARK PLUG AND METHOD FOR MANUFACTURING THE SPARK PLUG ELECTRODE MATERIAL AND AN ELECTRODE FOR THE SPARK PLUG

(75) Inventors: Lars Menken, Donzdorf (DE); Juergen Oberle, Sindelfingen (DE); Simone Baus, Bamberg (DE); Jochen Boehm, Marbach am Neckar (DE)

(73) Assignee: ROBERT BOSCH GMBH, Stuttgart (DE)

( * ) Notice: Subject to any disclaimer, the term of this patent is extended or adjusted under 35 U.S.C. 154(b) by 703 days.

This patent is subject to a terminal disclaimer.

(21) Appl. No.: 14/110,518

(22) PCT Filed: Feb. 15, 2012

(86) PCT No.: PCT/EP2012/052561

§ 371 (c)(1),
(2), (4) Date: Dec. 17, 2013

(87) PCT Pub. No.: WO2012/139790

PCT Pub. Date: Oct. 18, 2012

(65) Prior Publication Data

US 2014/0106063 A1 Apr. 17, 2014

(30) Foreign Application Priority Data

Apr. 15, 2011 (DE) ..... 10 2011 007 496

(51) Int. Cl.
*H01T 13/39* (2006.01)
*C22C 19/03* (2006.01)

(52) U.S. Cl.
CPC ..... *H01T 13/39* (2013.01); *C22C 19/03* (2013.01)

(58) Field of Classification Search
CPC ..... C22C 19/007; C22C 19/002; H01T 13/39
See application file for complete search history.

(56) References Cited

U.S. PATENT DOCUMENTS

| | | | | |
|---|---|---|---|---|
| 2,958,598 | A | 11/1960 | Douglas | |
| 7,521,850 | B2 * | 4/2009 | Lykowski | H01T 13/20 123/169 EL |
| 9,166,380 | B2 * | 10/2015 | Baus | H01T 13/39 |
| 2008/0308057 | A1 | 12/2008 | Lykowski et al. | |

FOREIGN PATENT DOCUMENTS

| | | |
|---|---|---|
| DE | 10 2009 46005 | 4/2011 |
| JP | 04-370686 | 12/1992 |
| JP | 2007-214136 | 8/2007 |
| JP | 2013-508557 | 3/2013 |

* cited by examiner

*Primary Examiner* — Jessee Roe
(74) *Attorney, Agent, or Firm* — Norton Rose Fulbright US LLP; Gerard Messina

(57) ABSTRACT

A spark plug electrode material containing a) 0.7 to 1.3% silicon by weight, b) 0.5 to 1.0% copper by weight, and c) nickel as the balance.

21 Claims, 2 Drawing Sheets

SPARK PLUG ELECTRODE MATERIAL AND SPARK PLUG AND METHOD FOR MANUFACTURING THE SPARK PLUG ELECTRODE MATERIAL AND AN ELECTRODE FOR THE SPARK PLUG

FIELD OF THE INVENTION

The present invention relates to a spark plug electrode material, as well as to a spark plug including an electrode that is made of the spark plug electrode material, and a method for manufacturing the spark plug electrode material and the electrode.

BACKGROUND INFORMATION

Different forms of spark plugs are believed to be understood in the related art. In spark ignition engines, spark plugs generate sparks between their electrodes for igniting the fuel-air mixture. In this connection, the spark plugs include ground electrodes and center electrodes, spark plug designs having two to five electrodes being known. In this connection, the electrodes are either mounted onto the spark plug housing (ground electrode) or introduced into a ceramic insulator as center electrodes. The service life of a spark plug is influenced by the corrosion and erosion resistance of the electrode material. Conventional electrode materials are based on nickel alloys including aluminum components. However, under operating conditions in the engine compartment, i.e., at high temperatures and in an oxidizing atmosphere, these have the problem that a major portion of the nickel surface, as well as a portion of the nickel in the interior of the electrode material, oxidizes due to reactions with the surrounding oxygen. This forms a nickel oxide layer, which has heat-insulating and electrical-conductivity-preventing characteristics and is already prone to corrosion and spark erosion after a short time. This increases the electrode spacing, which ultimately leads to the failure of the spark plug. If need be, the use of electrode materials made of pure precious metal or having a precious metal base, such as platinum or platinum alloys containing iridium, allows, in normal use of the spark plug, the formation of an oxide layer that has an increased wear resistance against spark-erosion attacks. However, such electrode materials, in particular, platinum, result in enormous costs, which are problematic in the case of such mass-produced components, such as spark plugs.

SUMMARY OF THE INVENTION

In contrast, the spark plug electrode material of the present invention, which has the features of claim 1, has the advantage that it is based on a nickel-based alloy, which keeps the costs of the electrode material and, therefore, the spark plug, low. In addition, this spark plug electrode material has the advantage that during normal use, i.e., at elevated temperature and in the presence of oxygen, a particularly homogenous, relatively thin oxide layer forms on at least a part of its surface within a very short time, mostly after just a few hours. This oxide layer features a high thermal conductivity of at least 6 W/mK, in particular, at least 8 W/mK, or even 10 W/mK and more, as well as a particularly high electrical conductivity. In this manner, the applied voltage and acting temperature may be distributed rapidly and uniformly over the entire electrode material, which means that temperature maxima and voltage maxima limited to a small region of the electrode surface, i.e., local temperature and voltage maxima, are prevented, which markedly reduces the corrosion and erosion of the electrode material.

In addition to the electrical conductivity and thermal conductivity, the selective use of silicon and copper also improves the oxidation resistance of the formed oxide layer and its thermodynamic stability as well, which means, in turn, that the wear of the electrode material due to spark erosion is reduced.

In this context, the level of silicon is in a range of 0.7 to 1.3% by weight, based on the total weight of the electrode material. The oxidation behavior of the electrode material and the electrical resistance of the oxide layer forming on the electrode material are already positively influenced at a low silicon level of 0.7% by weight. However, an opposite effect sets in at or above a silicon level of more than 1.3% by weight. The electrical resistance of the electrode material is further reduced by adding copper at a level of 0.5 to 1.0% by weight, based on the overall weight of the electrode material, since the copper ions are intercalated into the nickel oxide lattice, which means that the electrical conductivity of the formed oxide layer is increased. This effect is already measurable at a low copper level of 0.5% by weight. However, the level of copper should not exceed 1% by weight, since otherwise, a sufficient mechanical strength of the spark plug electrode material may no longer be adequately ensured. Therefore, the present invention follows a new path, since by suitably selecting the components of the electrode material, namely, nickel, copper and silicon, an oxide layer formed during normal use is optimized, and the main attention is not paid to the highest possible corrosion resistance, as in the related art.

Further refinements of the present invention are also described herein.

In the following, if not otherwise indicated, information regarding the amounts of the individual elements and compounds relates to, in each instance, the total weight of the spark plug electrode material.

In a particular embodiment, the spark plug electrode material to have a silicon level of 0.9 to 1.1% by weight, and in particular, 1% by weight, and/or a level of copper of 0.6 to 0.85% by weight, in particular, 0.75% by weight, the nickel level being approximately 97.5 to 98.5% by weight. At these levels, the added elements produce a particularly high thermal conductivity and electrical conductivity of the oxide layer formed during normal operation of the spark plug. The oxide layer formed is also sufficiently stable thermodynamically and mechanically, which means that the spark erosion and the corrosion of the spark plug electrode material of the present invention are also effectively reduced.

According to a further refinement of the present invention, the spark plug electrode material of the present invention is distinguished in that it also includes 0.07 to 0.13%, in particular, 0.09 to 0.11%, and especially 0.10% yttrium by weight. The addition of such small amounts of yttrium prevents abnormal grain growth during normal use of a spark plug, which includes the spark plug electrode material of the present invention. The yttrium level may be kept selectively low, for example, by a low oxygen content of the alloy. At or above a yttrium level of more than 0.13% by weight, the oxidation behavior and, therefore, also the electrical resistance of the formed oxide layer are negatively affected.

In a particular embodiment, the electrode material may be substantially free of aluminum and/or aluminum compounds and/or intermetallic phases. Aluminum and its compounds reduce the electrical conductivity of the electrode material and the formed oxide layer and therefore promote the spark erosion of the electrode material. By dispensing with aluminum, the oxidation behavior and, in particular, the electrical resistance of the formed oxide layer and, therefore, the erosion behavior of the spark plug electrode material is markedly improved (measurably improved). In addition, the deformability of the material is markedly improved. The omission of intermetallic phases also has a similar effect, since intermetallic phases are present in the nickel matrix as precipitates and produce thermomechanical stresses and a reduction of the thermal conductivity, which means that the spark erosion and the corrosion of the electrode material are increased.

According to a further refinement of the present invention, the spark plug electrode material is distinguished by a level of metallic impurities, which amounts to, in total, less than 0.15% by weight. In this context, metallic impurities include elements and compounds such as iron, titanium, chromium, manganese and the like. Such impurities reduce the effect of the increase in electrical conductivity and thermal conductivity, as is obtained by adding silicon and copper to the nickel base material in the indicated range. In addition, these impurities reduce the thermal conductivity of the alloy.

In a particular embodiment, the level of iron and/or chromium and/or titanium to be less than 0.05% by weight, in particular, less than 0.01% by weight, since these elements particularly affect the electrical conductivity of the oxide layer in a negative manner. The level of sulfur and/or sulfur compounds and/or carbon and/or carbon compounds may be less than 0.01% by weight, in particular, less than 0.005% by weight, and especially, less than 0.001% by weight, since these elements and compounds also have a negative effect on the oxidation behavior of the alloy; in particular, they may produce increased corrosion of the electrode material.

In a particular embodiment, the level of oxygen in the spark plug electrode material to be less than 0.003% by weight, in particular, less than 0.002% by weight, since oxygen promotes the oxidation of not only the nickel material, but also any impurities, which contributes, in turn, to increased corrosion of the electrode material.

According to a further refinement of the present invention, the spark plug electrode material is substantially made of, that is, apart from industrially caused, unavoidable impurities, 1% silicon by weight, 0.75% copper by weight and 0.1% yttrium by weight, the balance of the material being nickel and making up app. 98.15% by weight. In normal use, such an electrode material forms a stable, thin and uniform oxide layer having a high thermal conductivity of more than 10 W/mK and a low electrical resistance, that is, a high electrical conductivity. Consequently, the spark plug electrode material has reduced spark erosion and a markedly diminished tendency to corrode and is therefore well-suited for continuous use at high temperatures.

According to a further refinement of the present invention, the spark plug electrode material is substantially made of, that is, apart from industrially caused, unavoidable impurities, 0.7 to 1.3%, in particular, 1% silicon by weight, 0.5 to 1.0%, in particular, 0.75% copper by weight, 0.07 to 0.13%, in particular, 0.1% yttrium by weight, and contains less than 0.003%, in particular, less than 0.002% oxygen by weight, 0.001% sulfur by weight and 0.003% carbon by weight, the balance of the material being formed by nickel, and the level of metallic impurities amounting to, in total, less than 0.1% by weight. Due to its composition, this electrode material has minimal spark erosion and a very low tendency to corrode.

In addition, the present invention relates to a method for manufacturing the spark plug electrode material of the present invention, the method including the steps of producing a nickel-based alloy and adding further elements, such as silicon, copper and, in some instances, yttrium.

Furthermore, the present invention relates to a method for manufacturing a spark plug electrode, including the steps:

producing a nickel-based compound adding further elements forming an oxide layer having a thermal conductivity of at least 6 W/mK, in particular, at least 8 W/mK, and especially, at least 10 W/mK, as well as an electrical resistance that is less than or equal to that defined by the following equation:

$$\log R = a + b * T/1000,$$

where $0.6 \leq a \leq 0.8$, in particular, 0.7, $3.1 \leq b \leq 3.3$, in particular, 3.2, and T is the temperature in Kelvin on at least a portion of the surface of the spark plug electrode, the spark plug electrode material including the following elements prior to the formation of the oxide layer:

a) nickel as a base material, b) 0.7 to 1.3% silicon by weight and c) 0.5 to 1.0% copper by weight.

The spark plug electrode manufactured according to this method may be manufactured as both a single-material electrode and a two-material electrode, where in comparison with a single-material electrode, a two-material electrode only has the spark plug electrode material of the present invention as a cover material, in which case the core material is made, for example, out of copper. The core material may be provided in the form of profile wire.

The oxide layer, which forms at the surface of the spark plug electrode of the present invention, has an optimized structure. In this context, an optimized structure is understood to mean that the oxide layer has a uniform and stable bond, and that, in addition, it is relatively thin and even at the surface in comparison with oxide layers formed on conventional electrodes. This allows a low electrical resistance of the oxide layer at the electrode surface, which results in an improved electrical conductivity of this oxide layer. In addition, the thermal conductivity of the electrode material is also increased. The method of the present invention provides a spark plug electrode, which is made of inexpensive electrode material, is distinguished by an extremely high temperature resistance and a markedly reduced spark erosion, that is, low electrode arc erosion, and has excellent oxidation and corrosion resistance. Consequently, the spark plug electrode manufactured according to the present invention is also stable and erosion-resistant at high temperatures under the extreme conditions, as prevail in the combustion chamber of an engine.

The oxide layer may be formed through normal use of the spark plug electrode. An advantage of this is that the spark plug electrode may be stored as long as needed prior to its use, without experiencing a decrease in quality, and is first "activated" after initial operation via the formation of the oxide layer.

Furthermore, the present invention relates to an electrode made of the above-described spark plug electrode material, the electrode being able to be used as a center electrode and/or as a ground electrode, and both with and without a core, which may be a copper core or silver core, in the center and/or ground electrode.

In the following, an exemplary embodiment of the present invention is described in detail with reference to the accompanying drawing.

DETAILED DESCRIPTION

Figure 1:
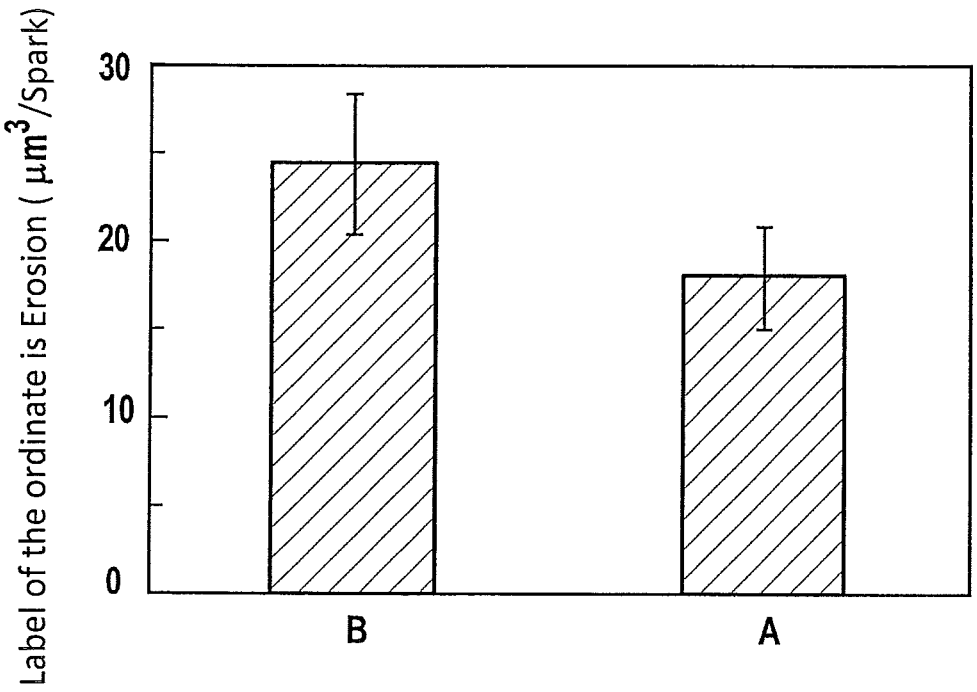
FIG. 1 shows a graph, which shows the erosion per ignition spark of the spark plug electrode material of the present invention in comparison with a conventional spark plug electrode material.

FIG. 1 is a graph, which shows the erosion in $\mu m^3$/spark, including standard deviation, of the spark plug electrode material A of the present invention in comparison with a conventional spark plug electrode material B, as described below.

The spark plug electrode material A of the present invention had the following composition:

a) 1% silicon by weight,
b) 0.75% copper by weight,
c) 0.1% yttrium by weight,
d) 0.002% oxygen by weight,
e) 0.001% sulfur by weight,
f) 0.003% carbon by weight, where the balance of the material was nickel, and the level of metallic impurities amounted to, in total, less than 0.1% by weight.

The conventional spark plug electrode material B had the following composition:

a) 1% silicon by weight,
b) 1% aluminum by weight,
c) 0.2% yttrium by weight, where the balance of the material was nickel. The specific levels of the elements of the spark plug electrode materials were determined using ICP.

The two materials A and B were subjected to a spark erosion test in air at an electrode temperature of 900° C., a pressure of 7 bar, and with the aid of ignition coils having a starting spark current of 90 mA. The graph clearly shows the elevated erosion per spark of app. 25 $\mu m^3$/spark of the conventional, aluminum-containing electrode material B, in comparison with the app. 18 $\mu m^3$/spark of the optimized spark plug electrode material A of the present invention. In this context, the markedly lower spark erosion of the electrode material A of the present invention may be attributed to the formation of a homogeneous, relatively thin oxide layer having excellent thermal conductivity and low electrical resistance, and thus, high electrical conductivity.

Figure 2:
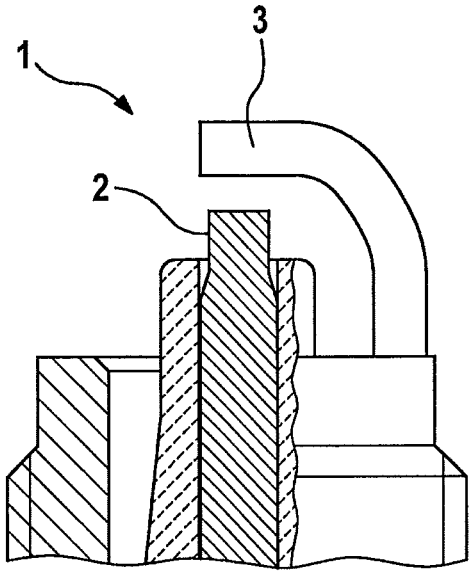
FIG. 2 shows a spark plug according to the present invention, including a ground electrode and a center electrode, the center electrode taking the form of a two-material electrode, and the ground electrode taking the form of a one-material electrode.

FIG. 2 shows a spark plug 1 according to the present invention, having a center electrode 2 and a ground electrode 3; both center electrode 2 and ground electrode 3 being made of the spark plug electrode material of the present invention. In this context, center electrode 2 takes the form of a two-material electrode, and ground electrode 3 takes the form of a one-material electrode.

Figure 3:
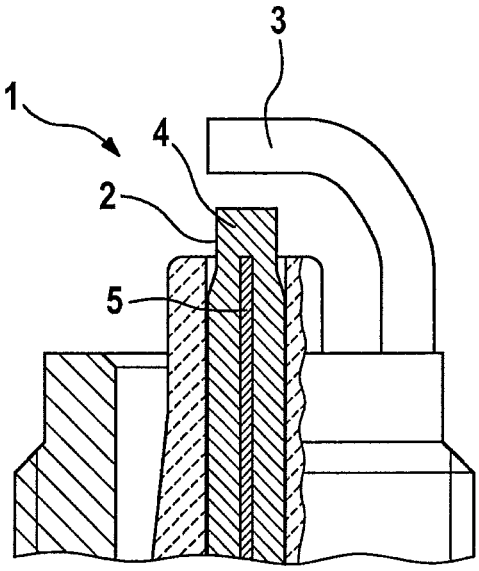
FIG. 3 shows a spark plug according to the present invention, including a ground electrode and a center electrode, the center electrode taking the form of a two-material electrode, and the ground electrode also taking the form of a two-material electrode.

FIG. 3 shows a spark plug 1 according to the present invention, having a center electrode 2 and a ground electrode 3, center electrode 2 and also ground electrode 3 taking the form of a two-material electrode, including an electrode cover 5 made of the spark plug electrode material of the present invention and an electrode core 4 made of a core material, which may be copper.

Therefore, the present invention provides a spark plug electrode material for manufacturing a spark plug electrode or, in general, a spark plug; due to the formation of an oxide layer during, in particular, normal use, the spark plug electrode material being distinguished by low spark erosion and excellent corrosion resistance with minimized production costs and sufficient thermodynamic and mechanical stability.

What is claimed is:

1. A spark plug electrode material, comprising:
0.7 to 1.3% silicon by weight;
0.5 to 1.0% copper by weight;
0.07 to 0.13% yttrium by weight; and
nickel as the balance.

2. The spark plug electrode material of claim 1, wherein the level of silicon is 0.9 to 1.1%, the level of copper is 0.6 to 0.85%, and the level of nickel is approximately 97.5 to 98.5% by weight.

3. The spark plug electrode material of claim 1, wherein the electrode material is free of aluminum, aluminum compounds, and intermetallic phases.

4. The spark plug electrode material of claim 1, wherein the level of metallic impurities amounts to, in total, less than 0.15% by weight.

5. The spark plug electrode material of claim 1, wherein the level of iron, chromium, and titanium is less than 0.05% by weight.

6. The spark plug electrode material of claim 1, wherein the level of sulfur, sulfur compounds, carbon, and carbon compounds is less than 0.01% by weight.

7. The spark plug electrode material of claim 1, wherein the level of oxygen is less than 0.003% by weight.

8. The spark plug electrode material of claim 1, including:
a) 98.15% nickel by weight,
b) 1% silicon by weight,
c) 0.75% copper by weight, and
d) 0.1% yttrium by weight.

9. The spark plug electrode material of claim 1, including:
a) 0.7 to 1.3% silicon by weight,
b) 0.5 to 1.0% copper by weight,
c) 0.07 to 0.13% yttrium by weight,
d) less than 0.003% oxygen by weight,
e) 0.001% sulfur by weight,
f) 0.003% carbon by weight,
g) balance: nickel, the level of metallic impurities amounting to, in total, less than 0.1% by weight.

10. The spark plug electrode material of claim 1, wherein the level of silicon is 1% by weight, and/or the level of copper is 0.75% by weight, and the level of nickel is approximately 97.5 to 98.5% by weight.

11. The spark plug electrode material of claim 1, wherein the level of iron chromium, and titanium is less than 0.01% by weight.

12. The spark plug electrode material of claim 1, wherein the level of sulfur, sulfur compounds, carbon, and carbon compounds is less than 0.005% by weight.

13. The spark plug electrode material of claim 1, wherein the level of oxygen is less than 0.003% by weight.

14. The spark plug electrode material of claim 1, including:

a) 1% silicon by weight, b) 0.75% copper by weight, c) 0.1% yttrium by weight, d) less than 0.002% oxygen by weight, e) 0.001% sulfur by weight, f) 0.003% carbon by weight, g) balance: nickel, the level of metallic impurities amounting to, in total, less than 0.1% by weight.

15. The spark plug electrode material of claim 1, wherein it further contains 0.10% yttrium by weight.

16. The spark plug electrode material of claim 1, wherein the level of sulfur, sulfur compounds, carbon, and carbon compounds is less than 0.001% by weight.

17. A spark plug, comprising:

an electrode made of a spark plug electrode material, including 0.7 to 1.3% silicon by weight, 0.5 to 1.0% copper by weight, 0.09 to 0.11% yttrium by weight, and nickel as the balance.

18. The spark plug of claim 17, wherein the electrode is a center electrode a copper core.

19. The spark plug of claim 17, wherein the electrode is a center electrode without a copper core.

20. The spark plug of claim 17, wherein the electrode is a ground electrode with a copper core.

21. The spark plug of claim 17, wherein the electrode is a ground electrode without a copper core.

* * * * *